US008640767B2

(12) United States Patent
Tucken

(10) Patent No.: US 8,640,767 B2
(45) Date of Patent: Feb. 4, 2014

(54) PUSH / PULL SYSTEM AND SUPPORT STRUCTURE FOR SNUBBING UNIT ON A RIG FLOOR

(75) Inventor: Brian Tucken, Hazlet (CA)

(73) Assignee: Team Snubbing Services Inc., Rocky Mountain House, Alberta (CA)

( * ) Notice: Subject to any disclaimer, the term of this patent is extended or adjusted under 35 U.S.C. 154(b) by 233 days.

(21) Appl. No.: 12/464,034

(22) Filed: May 11, 2009

(65) Prior Publication Data

US 2010/0193179 A1 Aug. 5, 2010

Related U.S. Application Data

(60) Provisional application No. 61/148,922, filed on Jan. 30, 2009.

(30) Foreign Application Priority Data

Jan. 30, 2009 (CA) ..... 2652068

(51) Int. Cl.
*E21B 19/086* (2006.01)

(52) U.S. Cl.
USPC ..... 166/77.4; 166/75.14; 166/77.53; 166/96.1; 166/381; 175/162; 175/203

(58) Field of Classification Search
USPC ..... 166/77.1, 75.14, 77.4, 77.51, 77.53, 166/96.1, 241, 380, 381, 383, 388, 382, 166/241.1; 175/52, 113, 162, 202, 203, 220
See application file for complete search history.

(56) References Cited

U.S. PATENT DOCUMENTS

| | | | | | |
|---|---|---|---|---|---|
| 3,722,603 | A * | 3/1973 | Brown | 173/159 |
| 3,722,607 | A * | 3/1973 | Ray | 175/57 |
| 3,888,318 | A * | 6/1975 | Brown | 173/149 |
| 4,119,297 | A * | 10/1978 | Gunther | 254/29 R |
| 4,479,547 | A * | 10/1984 | Boyadjieff et al. | 166/383 |
| 4,595,062 | A * | 6/1986 | Boyadjieff et al. | 166/379 |
| 6,386,284 | B1 * | 5/2002 | Buck et al. | 166/77.53 |
| 6,412,560 | B1 * | 7/2002 | Bernat | 166/301 |
| 6,681,894 | B1 * | 1/2004 | Fanguy | 182/113 |
| 6,688,393 | B2 * | 2/2004 | Sredensek et al. | 166/377 |
| 6,793,021 | B1 * | 9/2004 | Fanguy | 166/380 |
| 2006/0118294 | A1 * | 6/2006 | Haakenson | 166/77.52 |
| 2007/0289738 | A1 * | 12/2007 | Kampman et al. | 166/250.01 |
| 2008/0017371 | A1 * | 1/2008 | Khehra et al. | 166/250.01 |

* cited by examiner

*Primary Examiner* — David Bagnell
*Assistant Examiner* — Robert E Fuller
(74) *Attorney, Agent, or Firm* — Sander R. Gelsing

(57) ABSTRACT

A support structure for use on a rig floor and for supporting a unit used to manipulate tubular components through a wellhead comprises a support plate adapted to securely mount the support structure to said unit, a passage in the support plate of sufficient diameter to allow tubular components to pass therethrough, a plurality of rig engaging members and at least one tensile member mount. The unit used to manipulate tubular components through a wellhead may be a compact snubbing unit or may be a push/pull unit. The support structure may further comprise a worker platform to support a worker above the rig floor. Various push/pull system embodiments.

14 Claims, 18 Drawing Sheets

PUSH / PULL SYSTEM AND SUPPORT STRUCTURE FOR SNUBBING UNIT ON A RIG FLOOR

CROSS REFERENCE TO RELATED APPLICATION

This application is a regular application of U.S. Provisional Patent Application Ser. No. 61/148,922 filed Jan. 30, 2009 and entitled, "PUSH/PULL UNIT AND SUPPORT STRUCTURE FOR SNUBBING UNIT OR THE LIKE ON A RIG FLOOR", the entirety of which is incorporated herein by reference.

FIELD OF THE INVENTION

The invention relates to rigs above a wellhead, such as snubbing units and push/pull units, for manipulating tubing in and out of a well.

BACKGROUND OF THE INVENTION

It is well known to attach a variety of rigs such as hydraulically operated rigs above a wellhead. For example, snubbing units are known in the oil and gas industry for facilitating access to a well which is under pressure including, for example, well operations such as well completions. A snubbing unit includes structure and equipment above a wellhead for manipulating tubular components such as pipe, tubing, and bottom hole assemblies (BHA) in and out of a well while controlling the well under pressure.

Generally, a snubbing unit employs stationary (lower) and traveling (upper) slip assemblies, opposingly oriented, to releasably and controllably shift tubular components into and out of the well through a wellhead despite the possibility of either heavy tubular loads, which urge the tubular components to fall into the well, or the pressure-generated forces on the tubular components, which urge the tubular components out of the well. The snubbing unit is installed above an existing wellhead seal, such as that created by a blow-out preventer (BOP), and incorporates its own seals to seal the tubular components as they are introduced or removed from the wellhead, such as through the use of a stripping head.

Most conventional snubbing units fall into either rig-assisted or self-contained units. Rig-assisted snubbing units are typically snubbing units that are pivotally mounted to a truck and require assistance by an onsite service rig so as to winch them upright, pivoting from the truck, to a snubbing position over the wellhead. Self-contained units are typically transported to site on a truck and lifted into position, over the wellhead, by a separate crane unit. During operations, self-contained snubbing units do not require the assistance from an on-site rig.

When snubbing in low-pressure well environments, such as wells with surface pressures under 12,000 kPa, a compact, rig-assisted snubbing unit is often the ideal choice. A compact snubbing unit can be easily transported to the well site, such as in a 1 ton pickup truck, and is practical and cost effective for single wells and underbalanced drilling. Additionally, a compact snubbing unit reduces or eliminates viewing obstructions often experienced by service rig operators when utilizing traditional (larger) sized snubbing units. One example of a compact snubbing unit is the one marketed under the trade-mark MINI BRUTUS by Team Snubbing Services Inc. of Rocky Mountain House, Alberta, Canada.

Despite the many advantages of a compact snubbing unit, the set-up of such a unit still requires the snubbing unit to be installed above an existing wellhead seal and to incorporate its own seals to seal the tubular components as they are introduced or removed from the wellhead. Typically a compact snubbing unit, such as the MINI BRUTUS™, is installed above a blow-out preventer (BOP) and incorporates an RS-100 stripping head as its seal to seal the tubular components.

Push/pull systems or push/pull units are also known in the art and are used to manipulate tubular components in and out of a well. Push/pull units provide alternatives to, and/or improvements over, conventional snubbing systems. Such push/pull systems are generally mounted at the rig floor (e.g. on the rotary table) and, therefore, allow live well operations to be conducted at the rig floor rather than in the greatly elevated work baskets as is generally the case with conventional snubbing units. One example of a push/pull system is that manufactured by Tesco Corporation of Calgary, Alberta, Canada.

However, the prior art push/pull system manufactured by Tesco Corporation is cumbersome, large and heavy, does not have the compactness that has become associated with compact snubbing units such as the MINI BRUTUS™ and cannot be used to retrofit such compact snubbing units and/or convert such units into a push/pull system.

SUMMARY OF THE INVENTION

In an embodiment of the invention, a support structure for use on a rig floor and for supporting a unit used to manipulate tubular components through a wellhead comprises a support plate adapted to securely mount the support structure to said unit used to manipulate tubular components through a wellhead, a passage in the support plate of sufficient diameter to allow tubular components to pass therethrough, a plurality of rig engaging members and at least one tensile member mount.

In an embodiment where the unit used to manipulate tubular components through a wellhead further comprises a plurality of ram recesses, each such ram recess suitable to receive a jacking ram, the support structure preferably further comprises a plurality of ram passages coaxially aligned with the plurality of ram recesses, each ram passage being of sufficient diameter to allow a jacking ram to pass therethrough.

The unit used to manipulate tubular components through a wellhead may be a compact snubbing unit or may be a push/pull unit. Preferably, the plurality of rig engaging members are positioned between the support plate and the rig floor. More preferably, the support structure further comprising a worker platform to support a worker above the rig floor.

In another embodiment of the invention, a support structure for use on a rig floor and for supporting a unit used to manipulate tubular components through a wellhead, said unit having a plurality of jacking rams, comprises a support plate adapted to securely mount the support structure within said unit used to manipulate tubular components through a wellhead, a passage in the support plate of sufficient diameter to allow tubular components to pass therethrough, a plurality of rig engaging members, at least one tensile member mount and a plurality of ram passages in the support plate adapted to securably mount the plurality jacking rams. This embodiment of the support structure may further comprising a plurality of ram retainers to maintain secure placement of the plurality of jacking rams on the support plate.

In an embodiment wherein said unit used to manipulate tubular components through a wellhead further comprises a stationary plate and a stationary slip assembly, the support plate is preferably mounted between the stationary plate and the stationary slip assembly.

Various push/pull system embodiments, for use on a rig to manipulate tubular components through a wellhead, are also taught. These system embodiments preferably comprise a unit used to manipulate tubular components through a wellhead, one of the various embodiments of the support structure taught and at least one tensile member connected between the support structure and a mounting point on the rig or the rig's floor, said at least one tensile member adapted to overcome any well pressure-generated forces on the tubular components which would otherwise urge the tubular components out of the wellhead.

BRIEF DESCRIPTION OF THE DRAWINGS

Embodiments of the invention will now be described, by way of example only, with reference to the accompanying drawings, wherein.

DETAILED DESCRIPTION OF THE PREFERRED EMBODIMENTS

Figure 1:
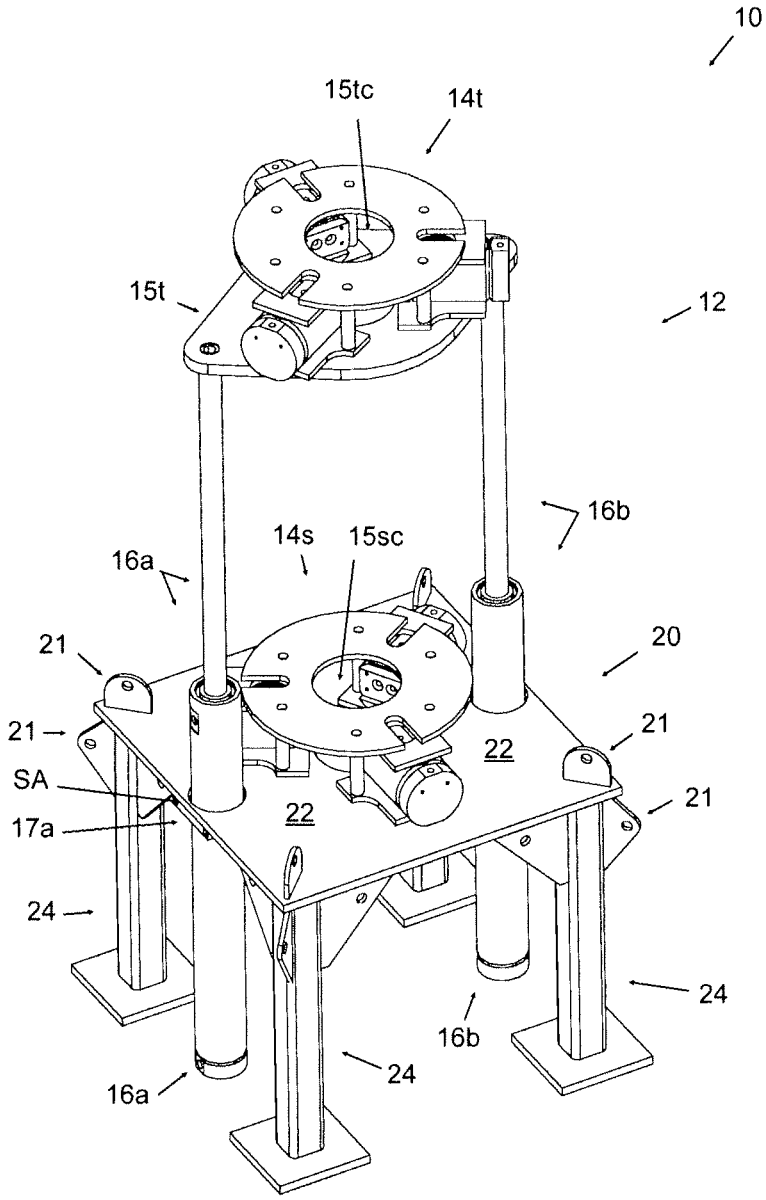
FIGS. 1-12 are various perspective views of one embodiment of the invention or of components thereof.
Figure 2:
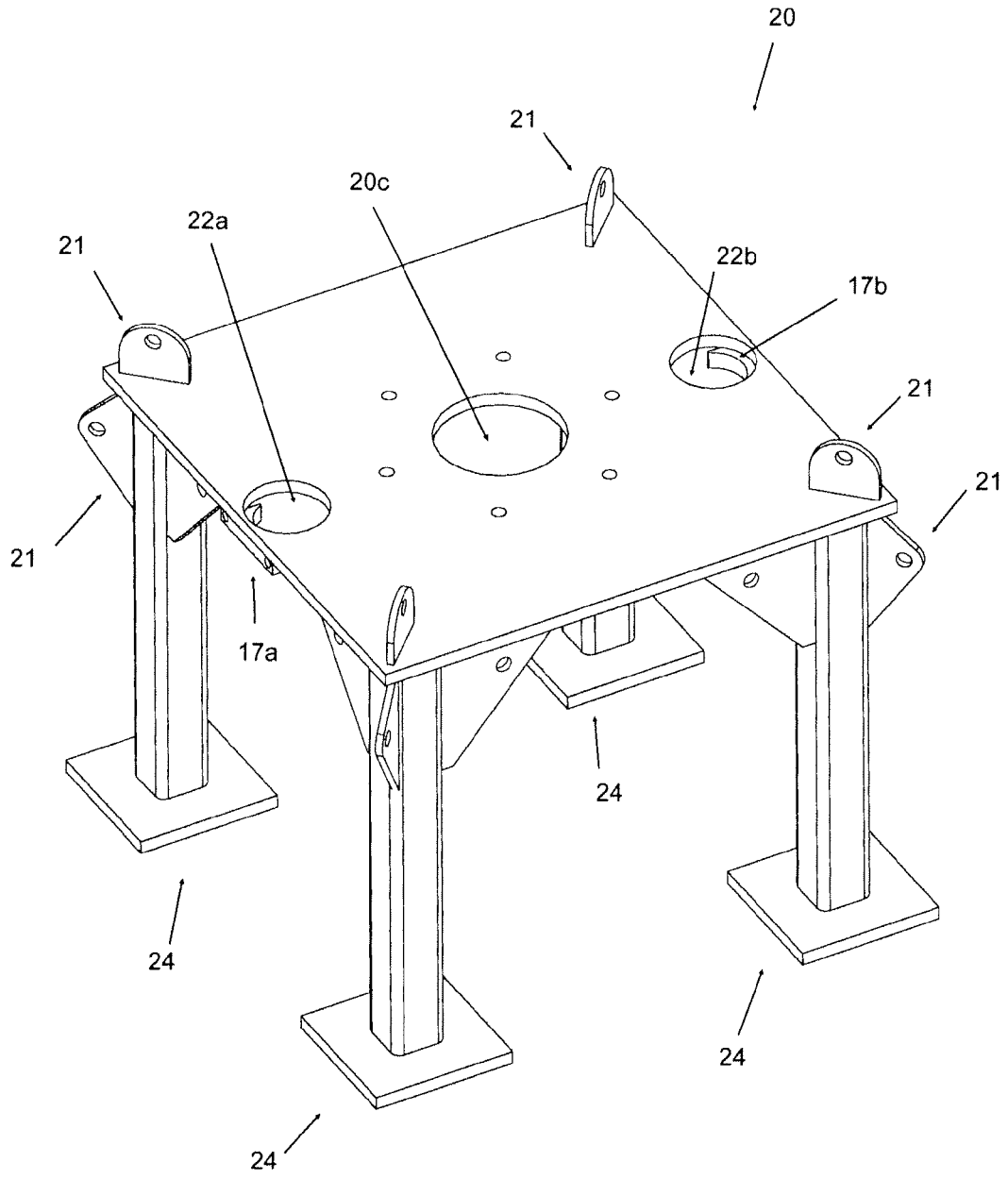
Figure 3:
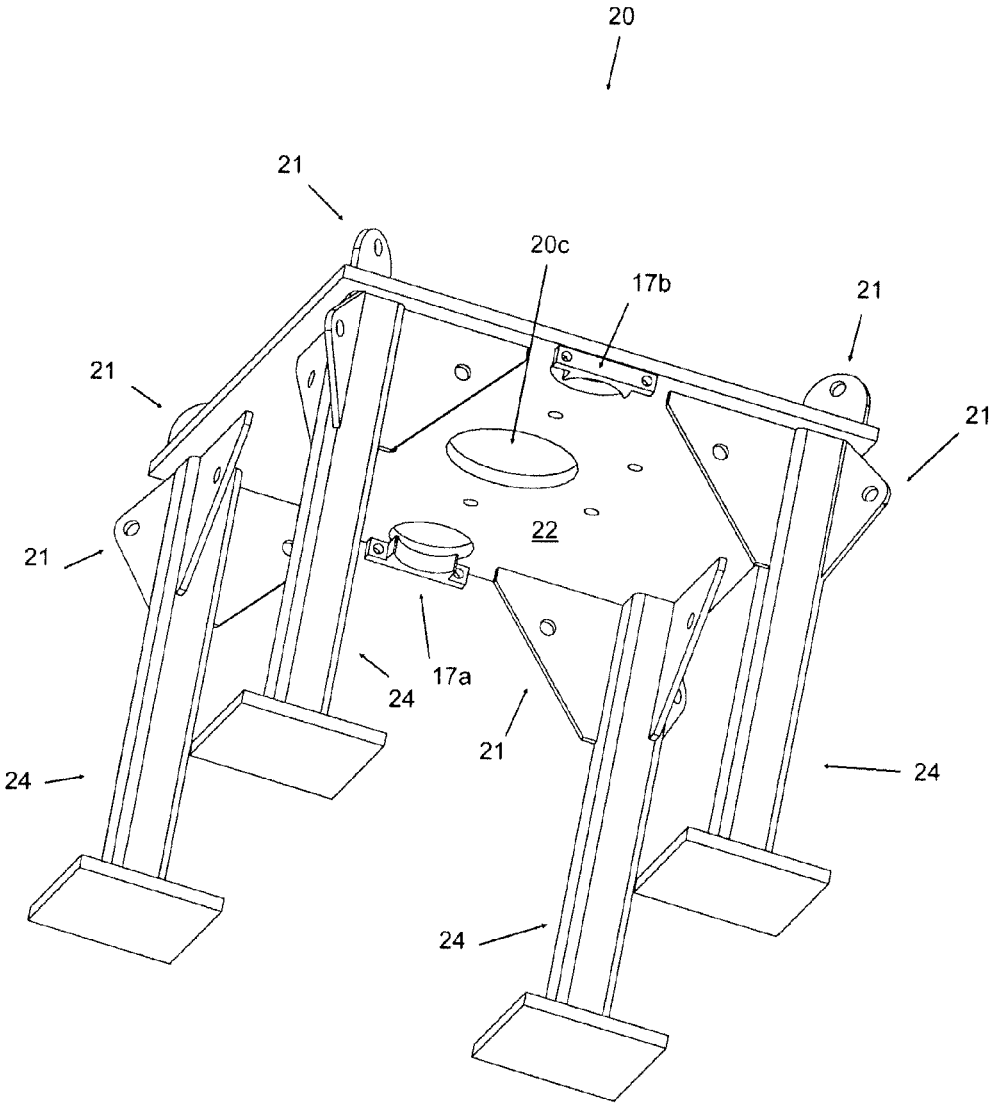
Figure 4:
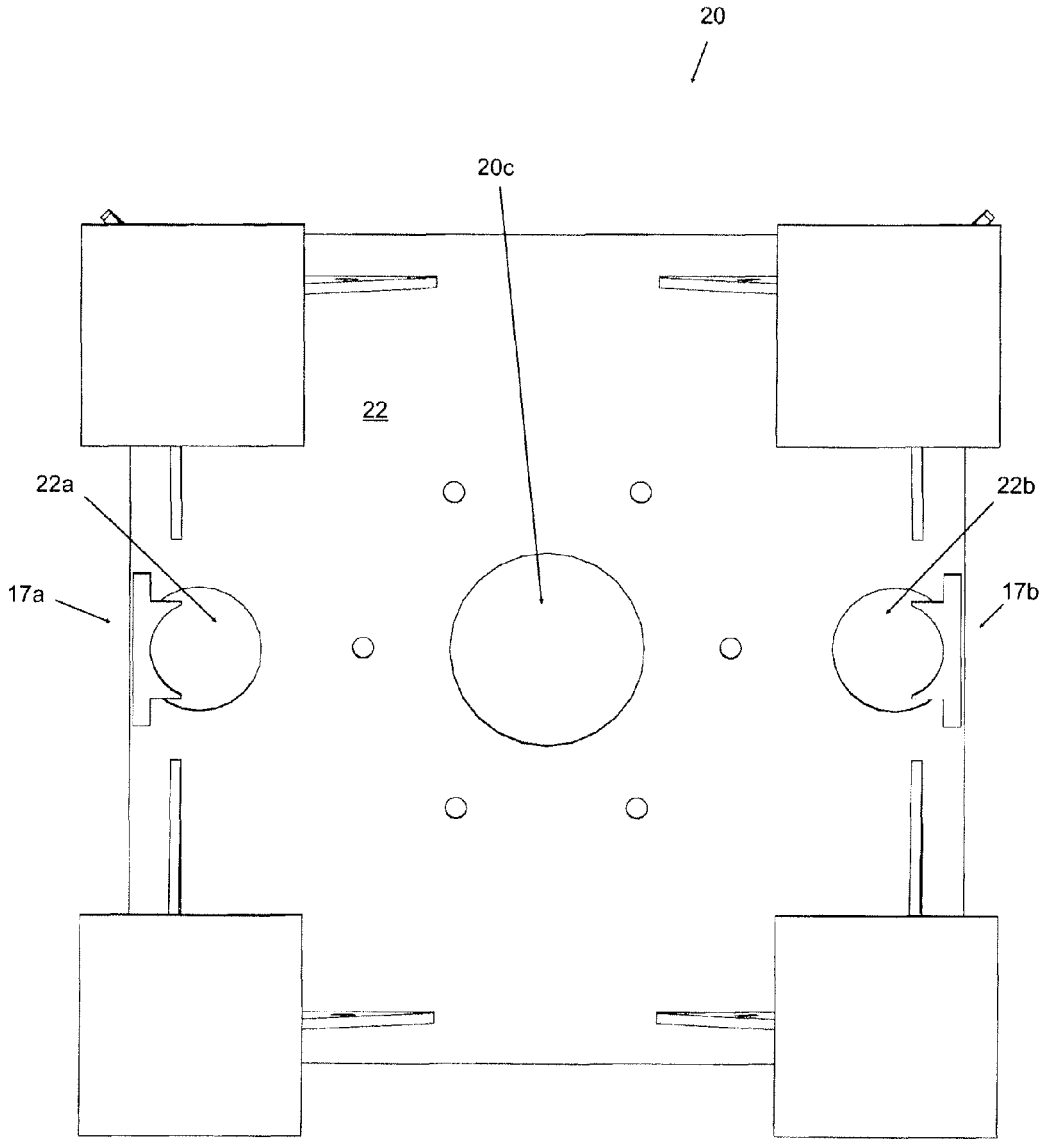
Figure 5:
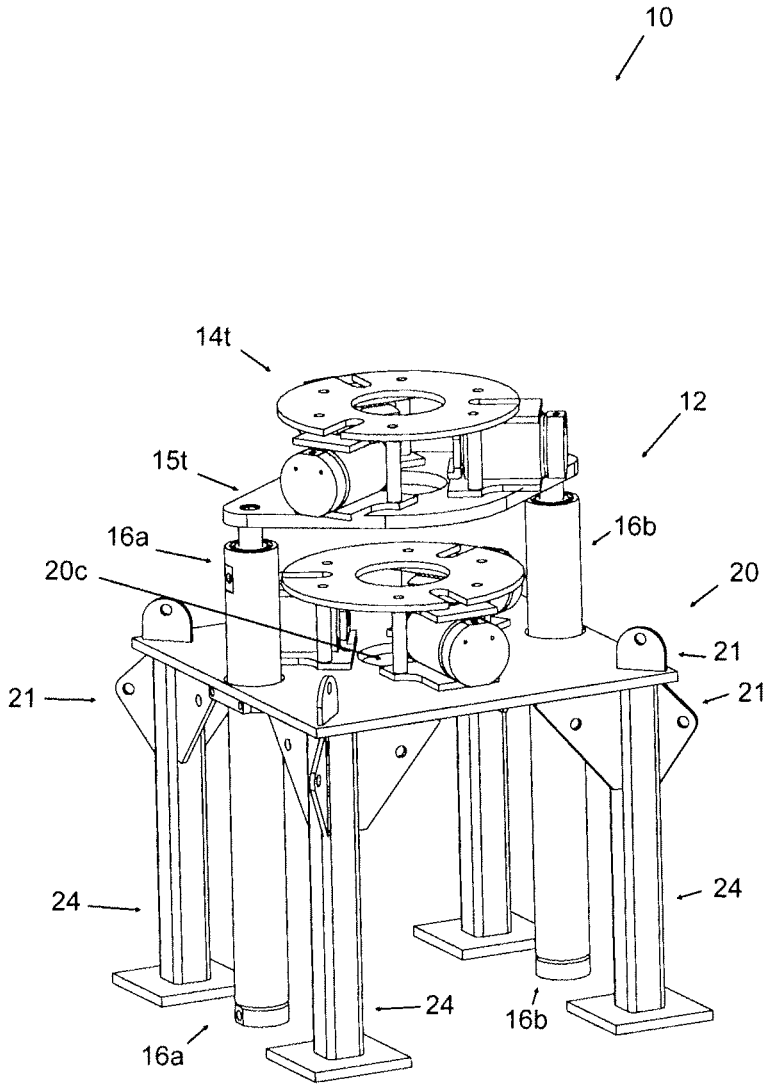
Figure 6:
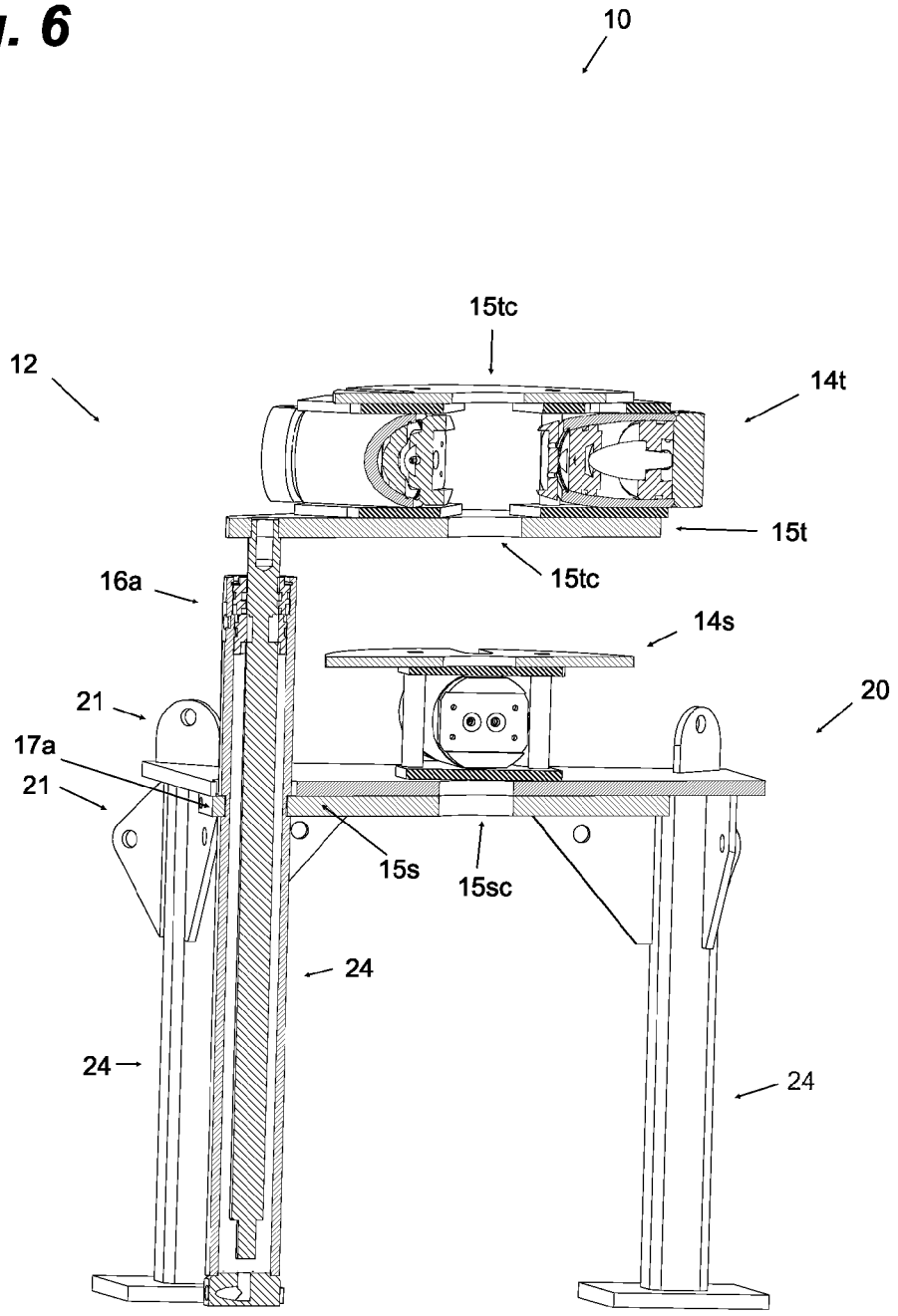
Figure 7:
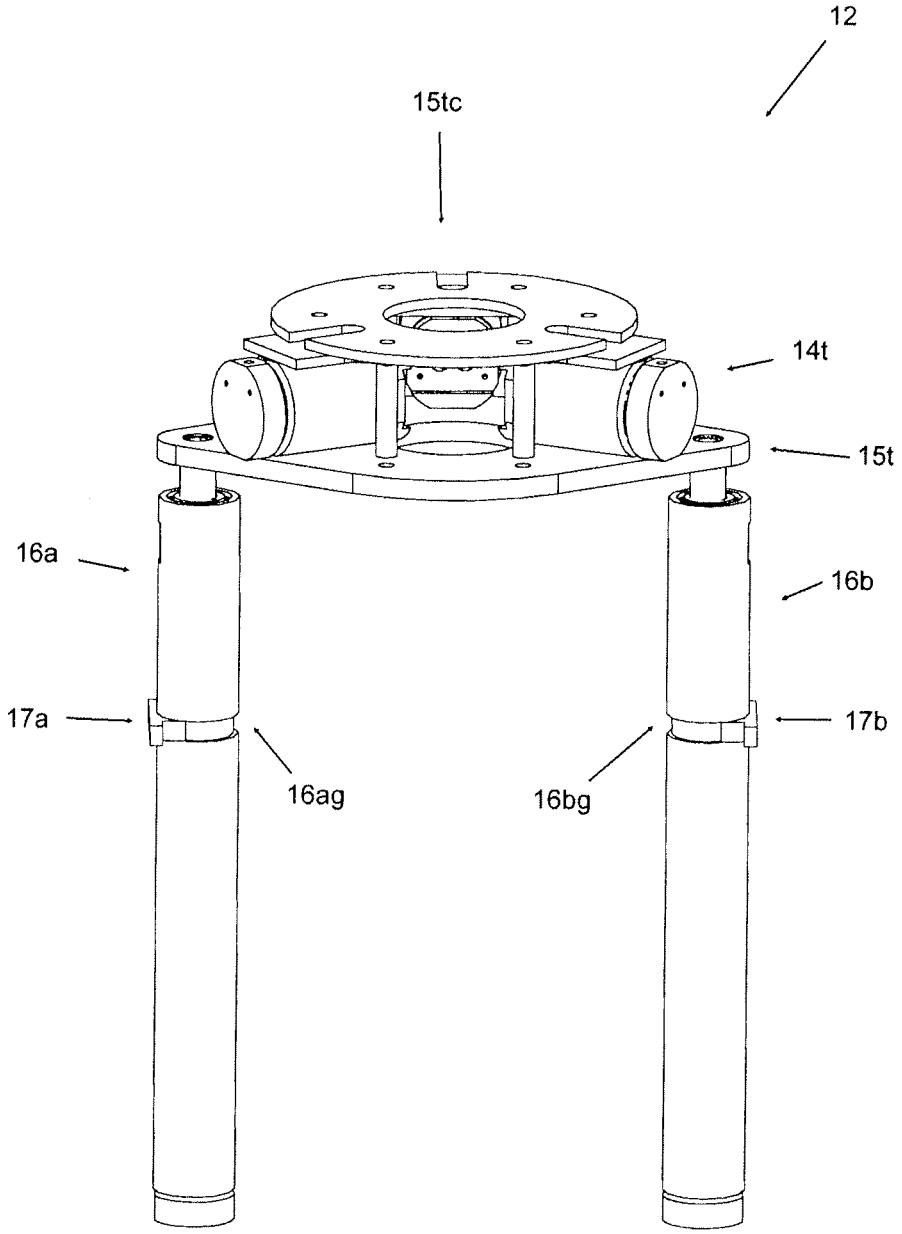
Figure 8:
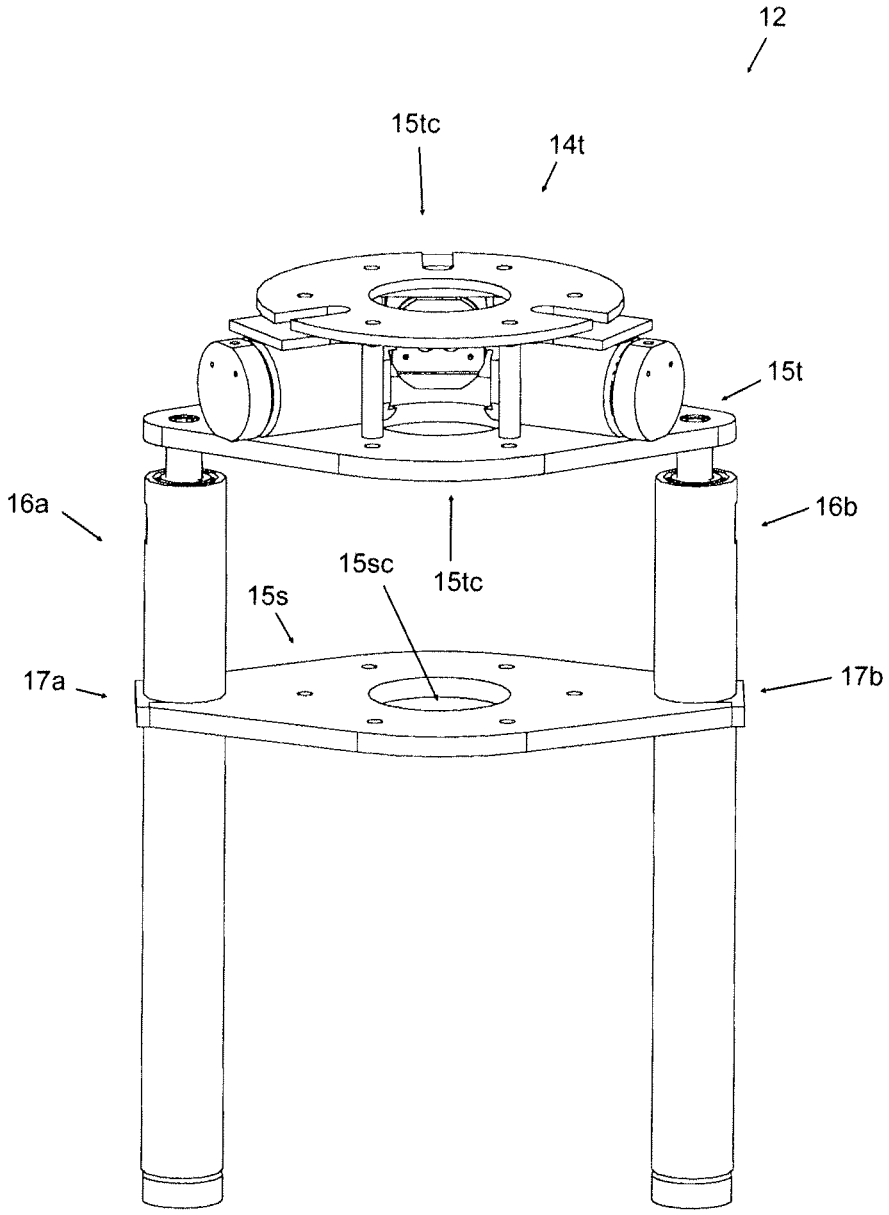
Figure 9:
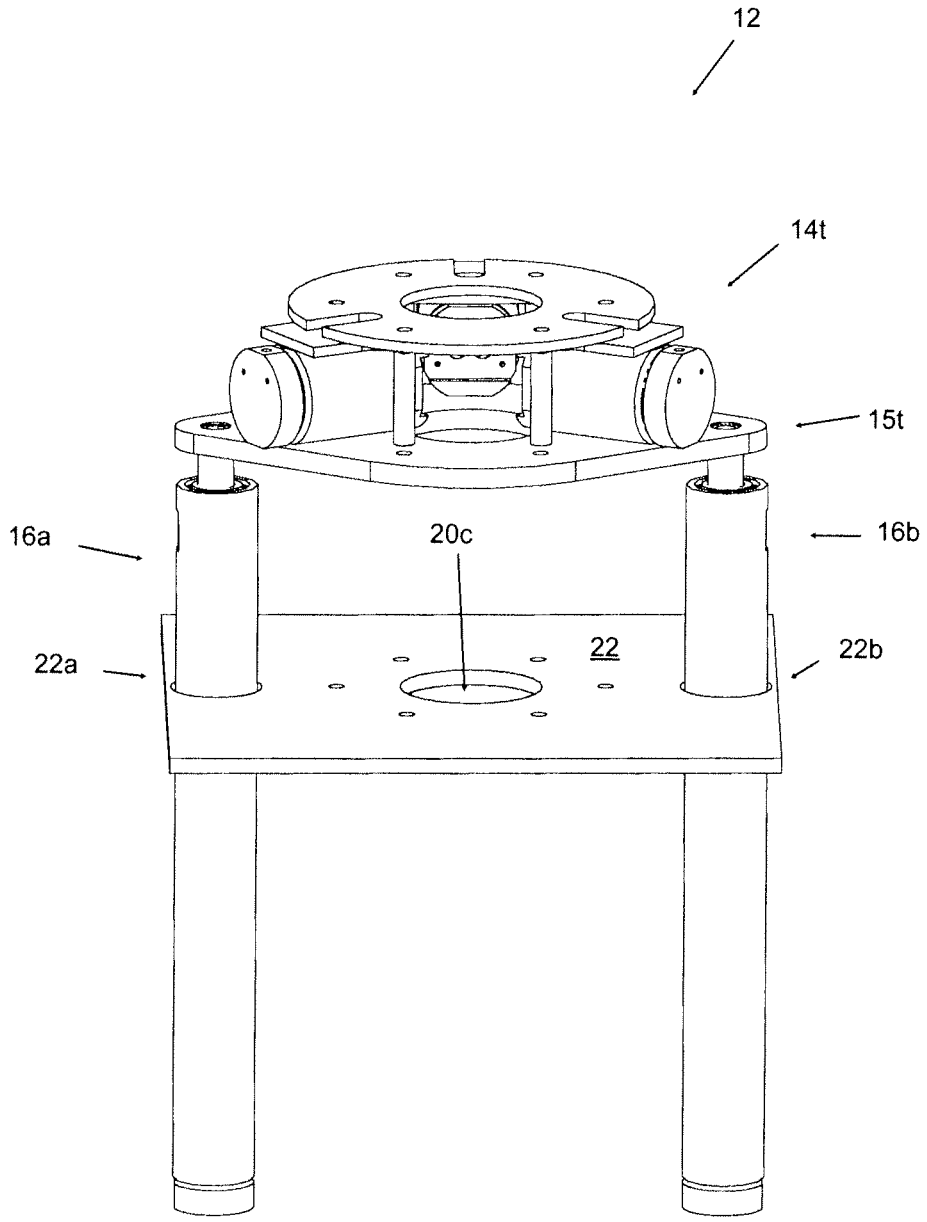
Figure 10:
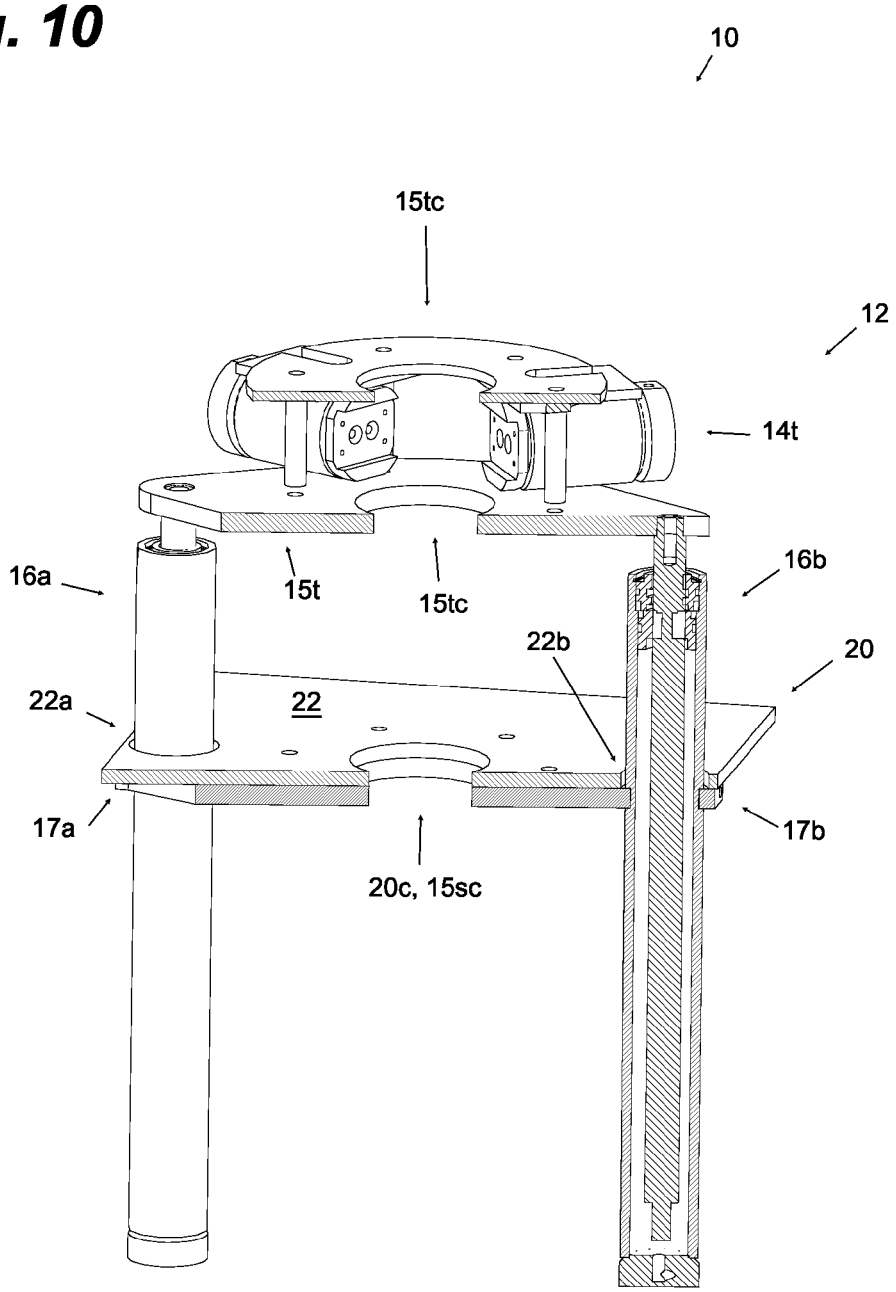
Figure 11:
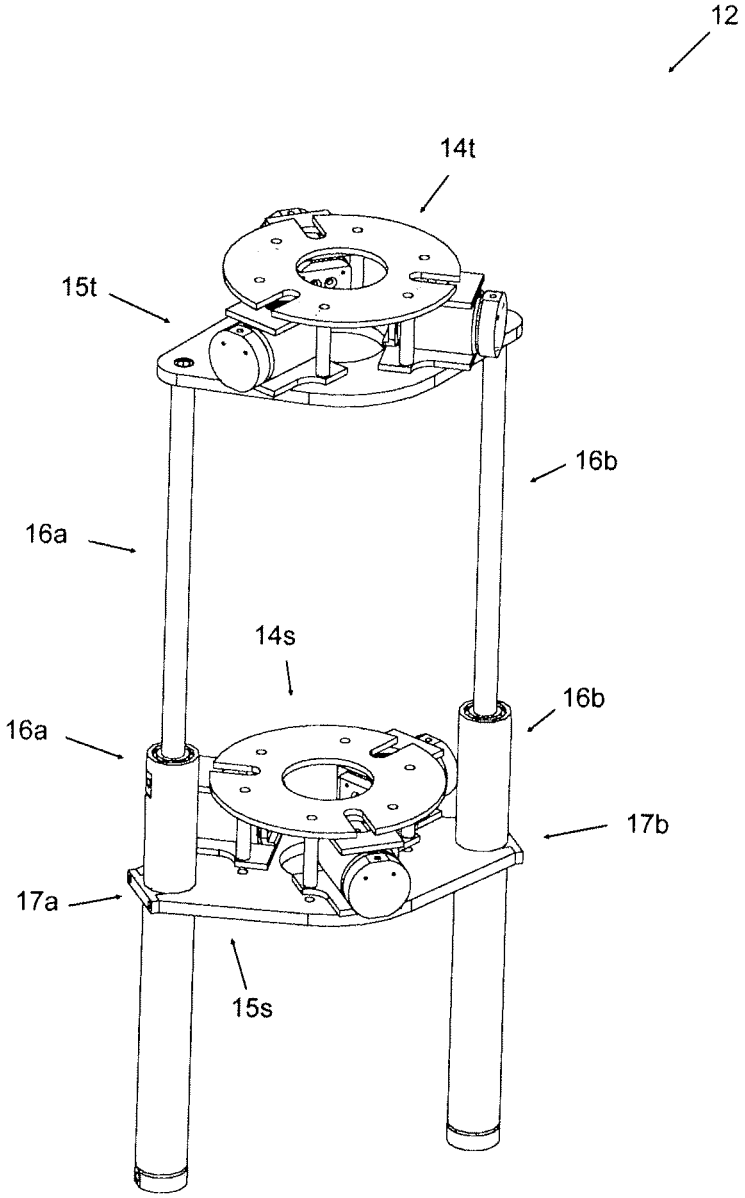
Figure 12:
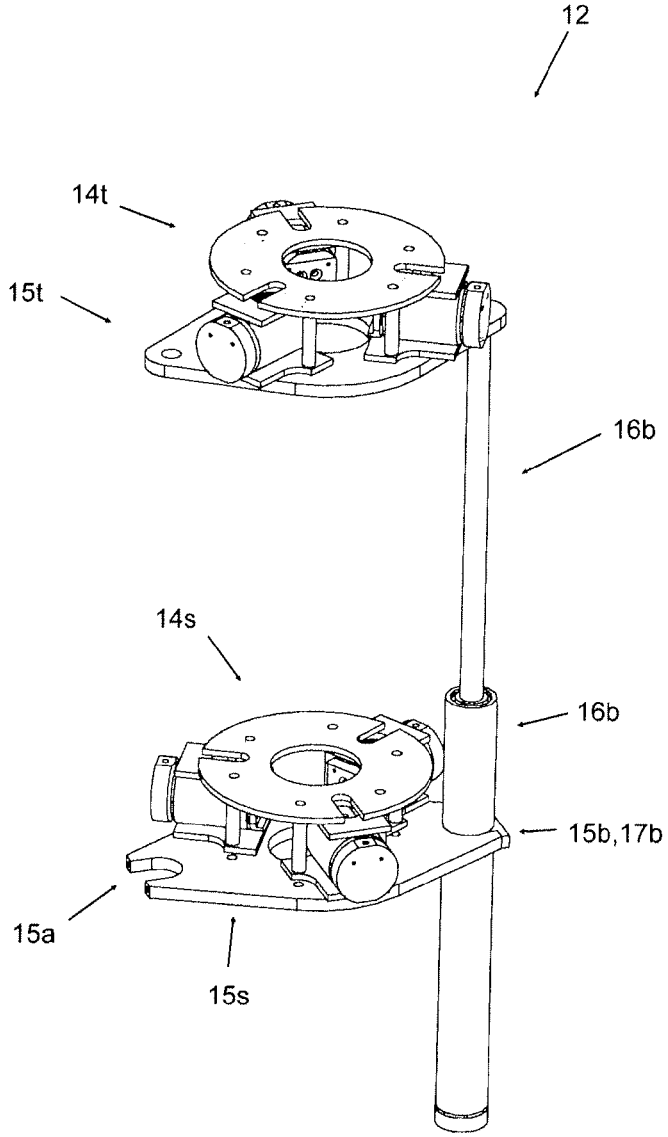

The following description is of preferred embodiments by way of example only and without limitation to the combination of features necessary for carrying the invention into effect. Reference is to be had to the Figures in which identical reference numbers identify similar components. The drawing figures are not necessarily to scale and certain features are shown in schematic form in the interest of clarity and conciseness.

FIGS. 1-12 illustrate the configuration of one embodiment of the present invention 10.

A compact snubbing unit 12 (or most of the components thereof) is shown being supported on a load bearing apparatus or support structure 20 having a central passage 20*c* of sufficient diameter to allow passage of tubular components T therethrough, preferably having at least one tensile member mount 21 to facilitate the connection of one or more tensile members 40 between the support structure 20 and a mounting point on a rig or rig floor RF and having a support member or support plate 22. The support plate 22 is adapted to be secured to, or within, the compact snubbing unit 12. Unless otherwise specified, it is preferred that the components of the invention be made of steel or other suitable high-strength materials capable of taking stresses and strains during its intended use during well operations.

In this embodiment, compact snubbing unit 12 comprises stationary (lower) and traveling (upper) slip assemblies 14*s*, 14*t*, traveling plate 15*t* (to support the travelling slip assembly 14*t* and having a central passage 15*tc* of sufficient diameter to allow passage of tubular components T therethrough), bottom or stationary plate 15*s* (to facilitate mounting of the compact snubbing unit 12 to the support structure 20 and having a central passage 15*sc* of sufficient diameter to allow passage of tubular components T therethrough) and a pair of jacking rams 16*a*, 16*b* securely mounted to the stationary plate 15*s* and actuatable in a conventional manner to releasably and controllably shift tubular components T into and out of the well through a wellhead. Preferably, jacking rams 16*a*, 16*b* are hydraulic rams.

In this embodiment, compact snubbing unit 12 does not comprise a seal to seal the tubular components (such as an RS-100 stripping head as would typically be provided with such compact snubbing unit). One example of a suitable compact snubbing unit 12 is the MINI BRUTUS™ manufactured by Team Snubbing Services Inc. of Rocky Mountain House, Alberta, Canada, but without the RS-100 stripping unit or with such a stripping unit having been subsequently removed (see FIGS. 11-12).

In an alternate embodiment (not shown), a compact snubbing unit 12 with a stripping unit is provided, but such a stripping unit would be mostly redundant and unnecessary in typical push/pull applications, and would therefore be unnecessarily adding to the cost and/or complexity of the invention 10.

Preferably, jacking rams 16*a*, 16*b* are securely mounted to the compact snubbing unit 12 in the conventional manner, such as is done in the MINI BRUTUS™ compact snubbing unit. In this embodiment, the stationary plate 15*s* comprises paired ram cut-outs or recesses 15*a*, 15*b*, said ram recesses 15*a*, 15*b* being substantially positioned at 180° across from each other around central passage 15*sc* and at the periphery of the stationary plate 15*s* (see FIG. 12). Further in this embodiment, the jacking rams 16*a*, 16*b* each comprise an annular groove 16*ag*, 16*bg* of such diameter and dimensions to allow secure placement of the jacking rams 16*a*, 16*b* within the ram recesses 15*a*, 15*b* (see FIG. 7) and the compact snubbing unit 12 further comprises ram keepers or ram retainers 17*a*, 17*b*. As such, jacking rams 16*a*, 16*b* are securely mounted to the compact snubbing unit 12 in the conventional manner, such as is done in the MINI BRUTUS™ compact snubbing unit, by placing the annular grooves 16*ag*, 16*bg* of jacking rams 16*a*, 16*b* within the respective ram recesses 15*a*, 15*b* and then bolting or otherwise fasten the ram retainers 17*a*, 17*b* so as to maintain secure placement of the jacking rams 16*a*, 16*b* on the stationary plate 15*s* (see FIGS. 6-8, 10 and 11).

In this embodiment, the support structure 20 further comprises ram openings or ram passages 22*a*, 22*b*, in the support plate 22, each ram passage 22*a*, 22*b* being coaxially aligned with ram recesses 15*a*, 15*b* of the stationary plate 15*s* and each ram passage 22*a*, 22*b* being of sufficient diameter to allow passage of the jacking rams 16*a*, 16*b* therethrough (see FIGS. 1, 5-6, 9 and 10). Preferably, ram passages 22*a*, 22*b*, while allowing of passage of the jacking rams 16*a*, 16*b* therethrough, are positioned and are of such dimensions so as to have the support structure 20 still provide some contact surface area SA or support for the ram retainers 17*a*, 17*b* and are not so large so as to also allow passage of said ram retainers 17*a*, 17*b* therethrough when the compact snubbing unit 12 is mounted to the support structure 20 and the invention is subject to pushing or pulling forces from the tubular components T. Preferably, and as more clearly shown in FIGS. 1-6, the support structure 20 comprises a plurality of rig engaging members or legs 24 distributed around and connected to the support plate 22.

In the preferred embodiment, support plate 22 is secured to the compact snubbing unit 12 by bolting or fastening to the stationary plate 15*s* in a conventional manner. In the preferred embodiment, the stationary slip assembly 14*s* is unfastened from the stationary plate 15*s*, stationary plate 15*s* and ram retainers 17*a*, 17*b* are fastened directly underneath the support plate 22 and stationary slip assembly 14*s* is placed and fastened directly above the support plate 22 thereby sandwiching the support plate 22 between the stationary slip assembly 14*s* and the stationary plate 15*s* (see FIGS. 6 and 10). As such, support structure 20 is mounted within the compact snubbing unit 12 and allows one to easily retrofit such a compact snubbing unit 12 to become a push/pull unit.

Advantageously, by mounting the stationary plate 15*s* and ram retainers 17*a*, 17*b* directly underneath and against the lower surface of the support plate 22, and/or by provide some contact surface area SA or support for the ram retainers 17*a*, 17*b*, the invention 10 can more easily accommodate significant upward forces, such as those which might be created when well pressure-generated forces on the tubular components T urges the tubular components T out of the well. More advantageously, the invention 10 can be utilized to reduce or eliminate the chance of a well blowout, such as that which might occur during under balanced drilling operations, ejecting the tubular components T out of the well.

In another embodiment (not shown), the stationary plate 15*s* is fastened directly on top of and against the top surface of the support plate 22 and then the invention 10 can more easily accommodate significant downward forces, such as those which might be created when heavy tubular loads urge the tubular components T to fall into the well.

During operations, the support structure 20 is positioned on a rig floor RF above a wellhead (not shown) extending from the ground and including standard wellhead components and wellhead seals. Loads and downward forces from the compact snubbing unit 12 and/or tubular components T are generally distributed into the rig floor RF through the support structure 20 and legs 24. Where upward forces (e.g. where the well pressure-generated forces on the tubular components T urge the tubular components T out of the well) are expected to be incurred, one or more tensile members 40 can be utilized to further secure the support structure 20 to the rig or rig floor RF via the tensile member mounts 21. Preferably, tensile members 40 are chains and fasten the support structure 20 to the rig floor RF in a conventional manner.

Second Embodiment

Figure 13:
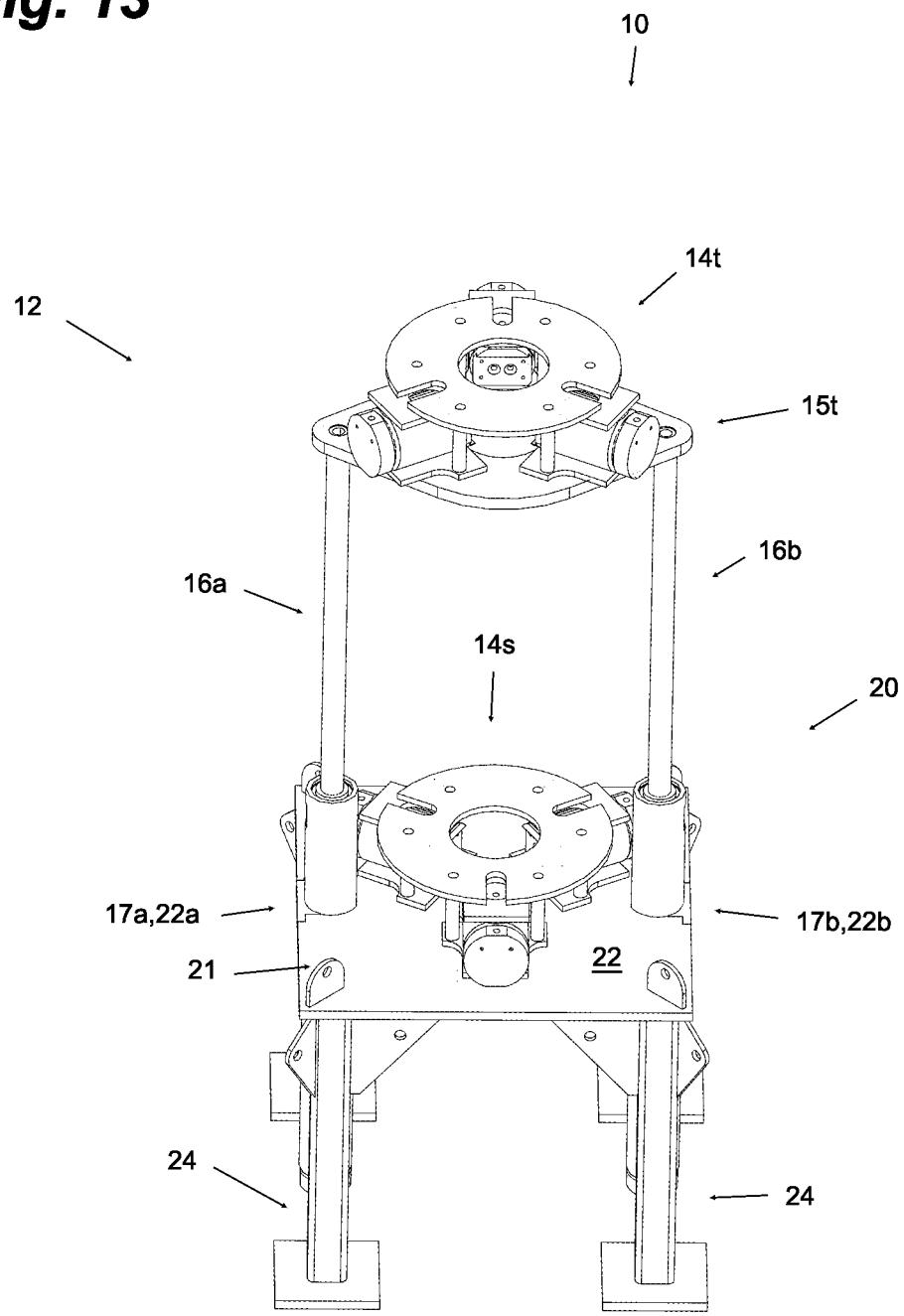
FIG. 13 is a perspective view of another embodiment of the invention.
Figure 14:
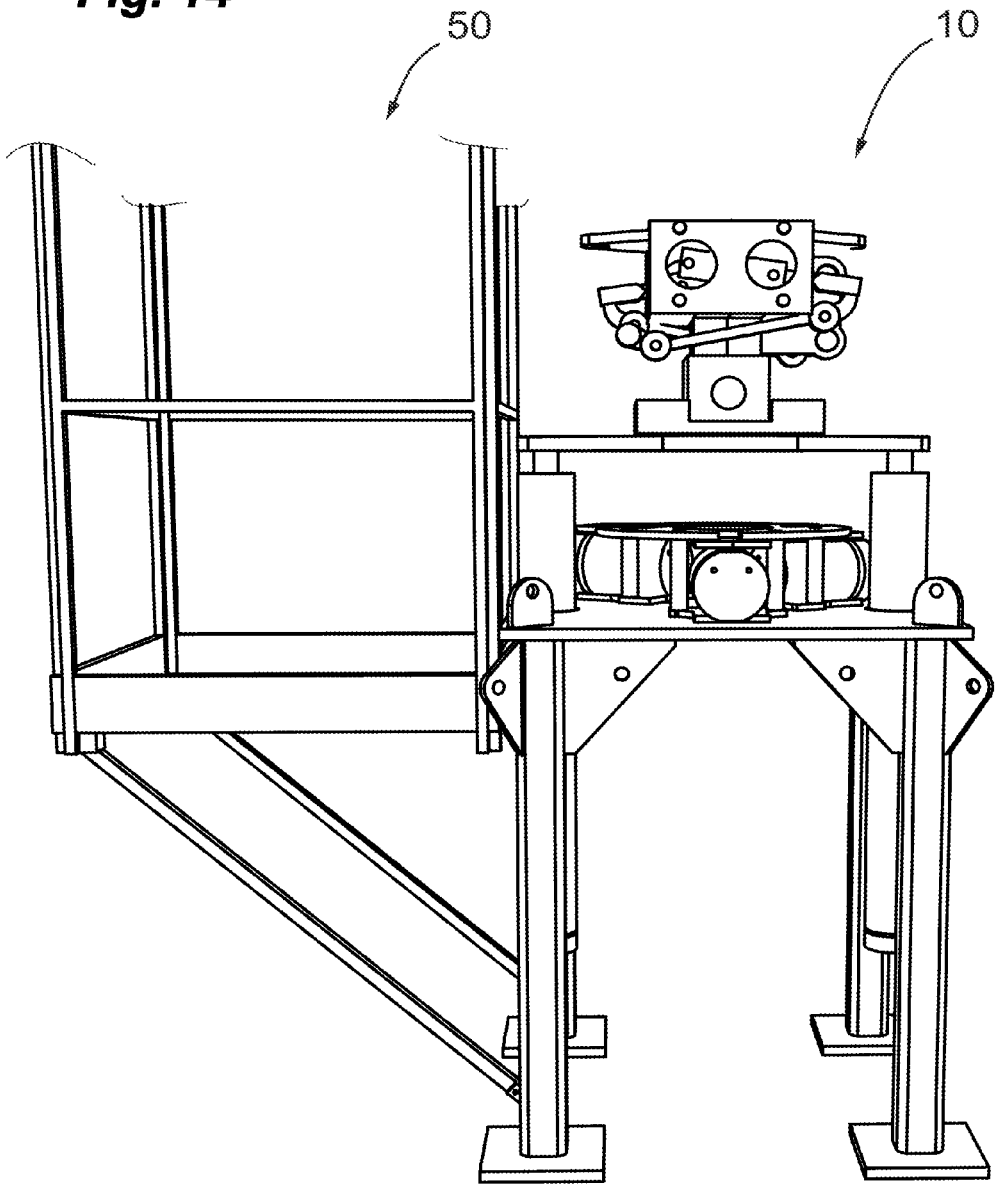
FIGS. 14-18 are various perspective views of yet another embodiment of the invention, shown positioned on a rig floor of a rig and having a platform to support a worker.
Figure 15:
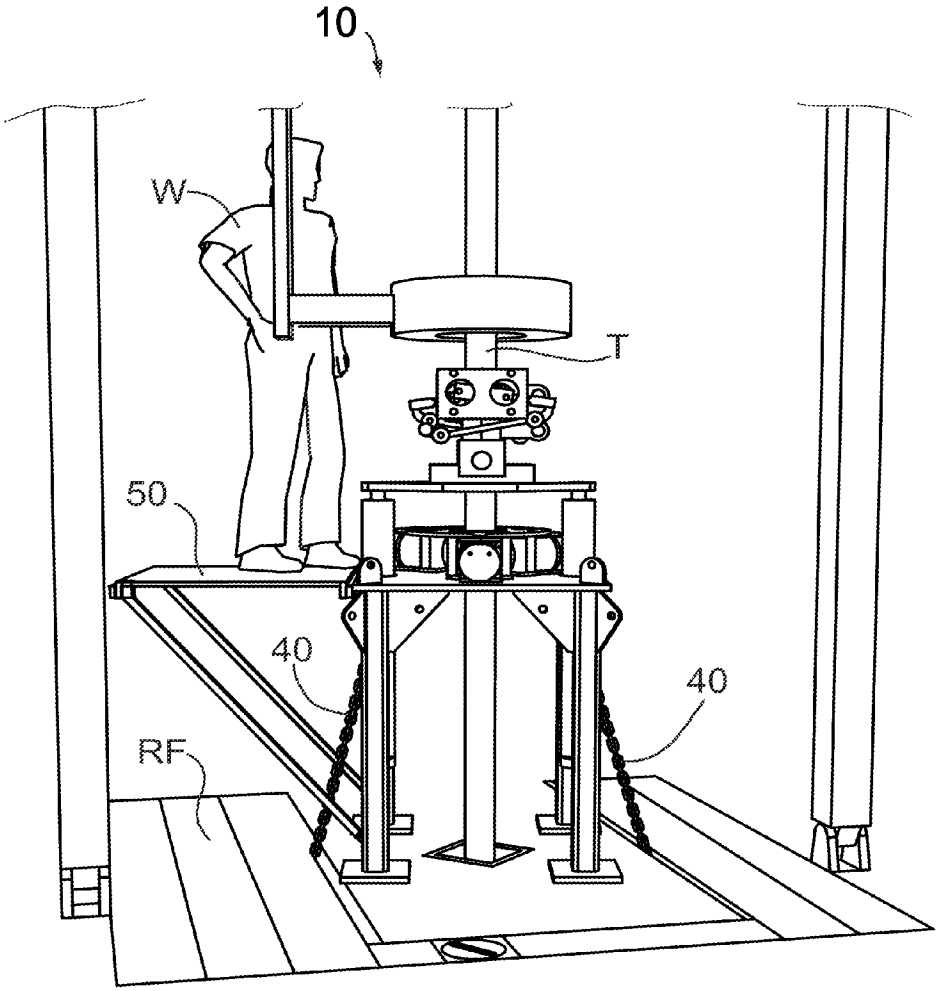
Figure 16:
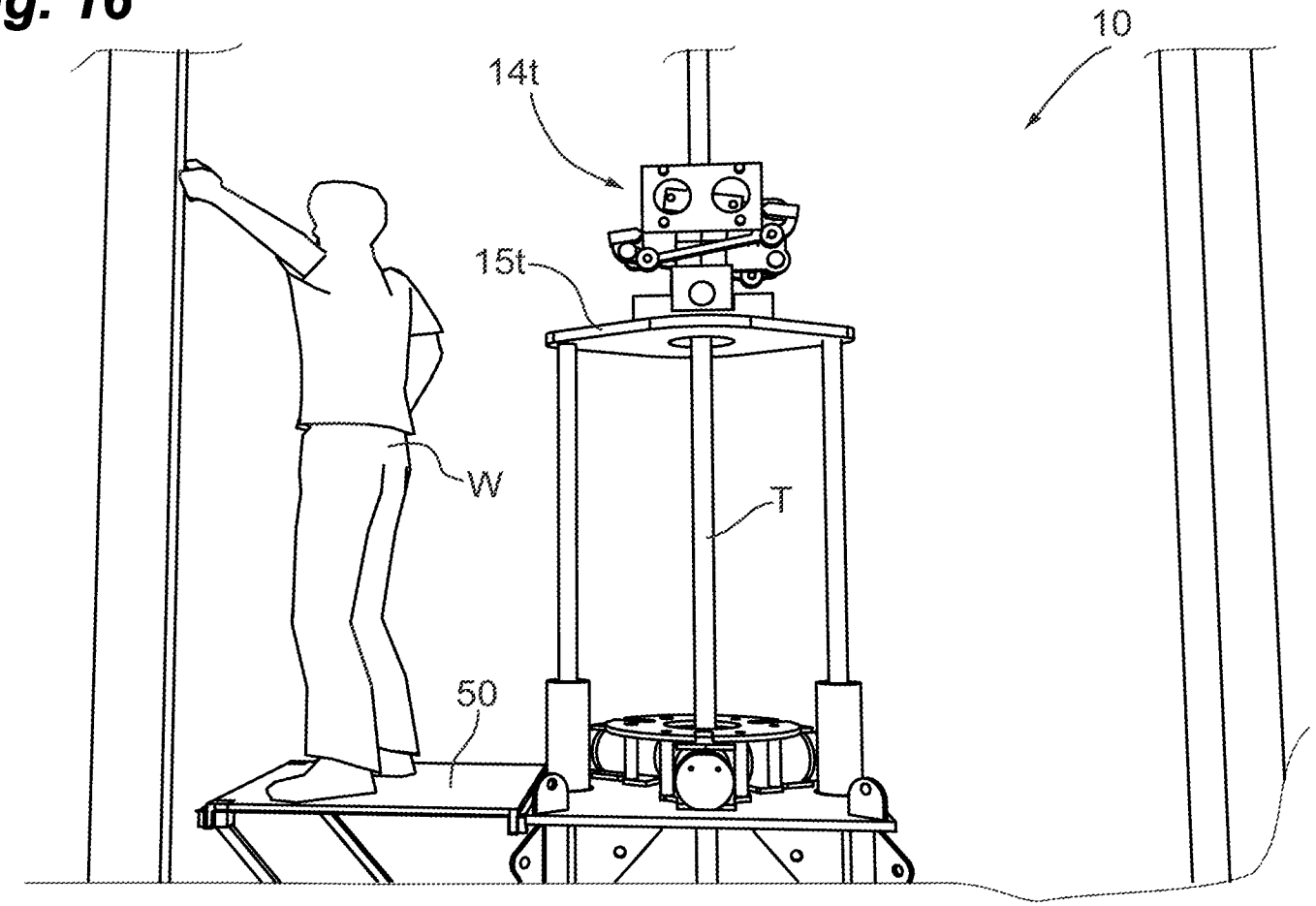
Figure 17:
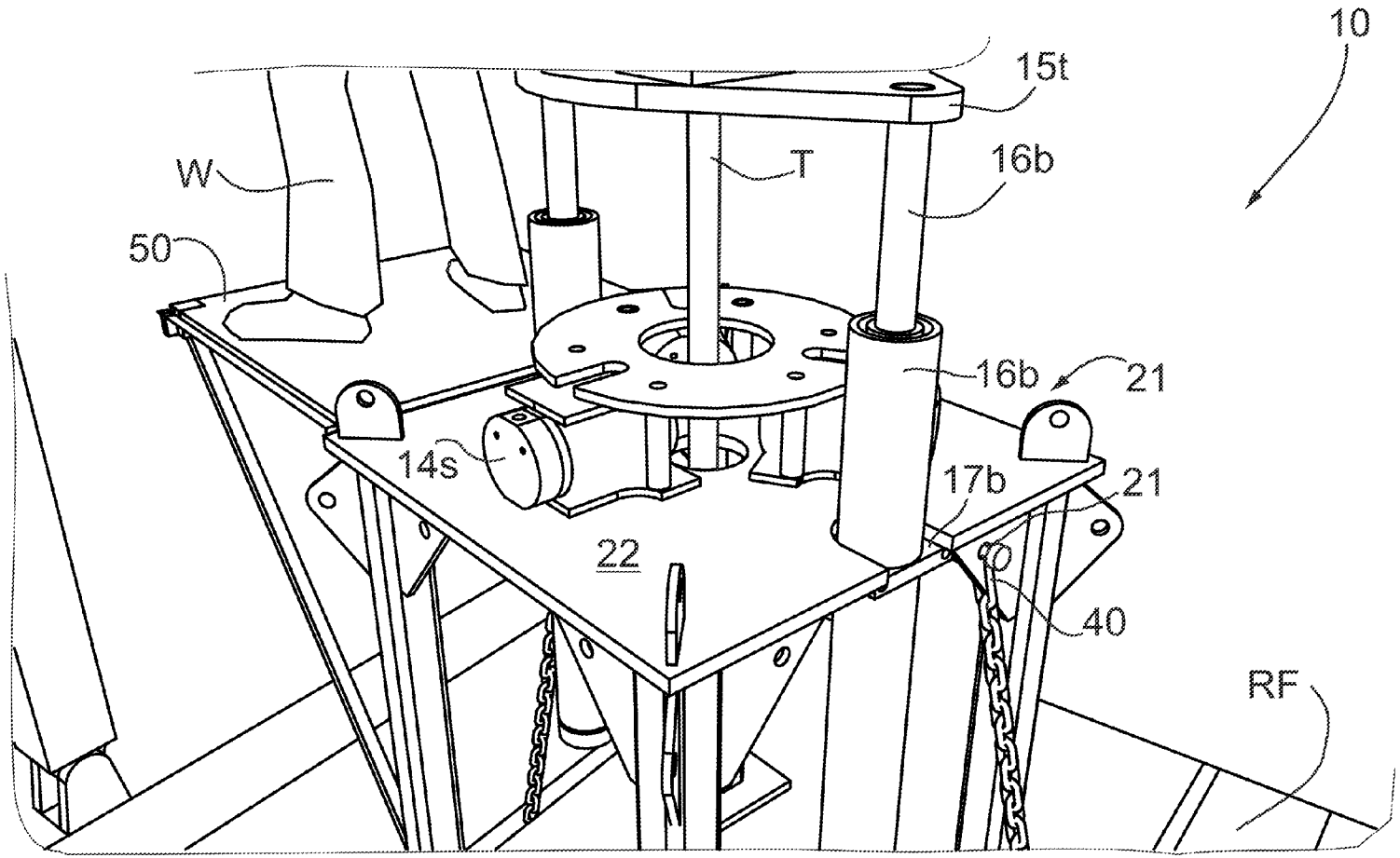
Figure 18:
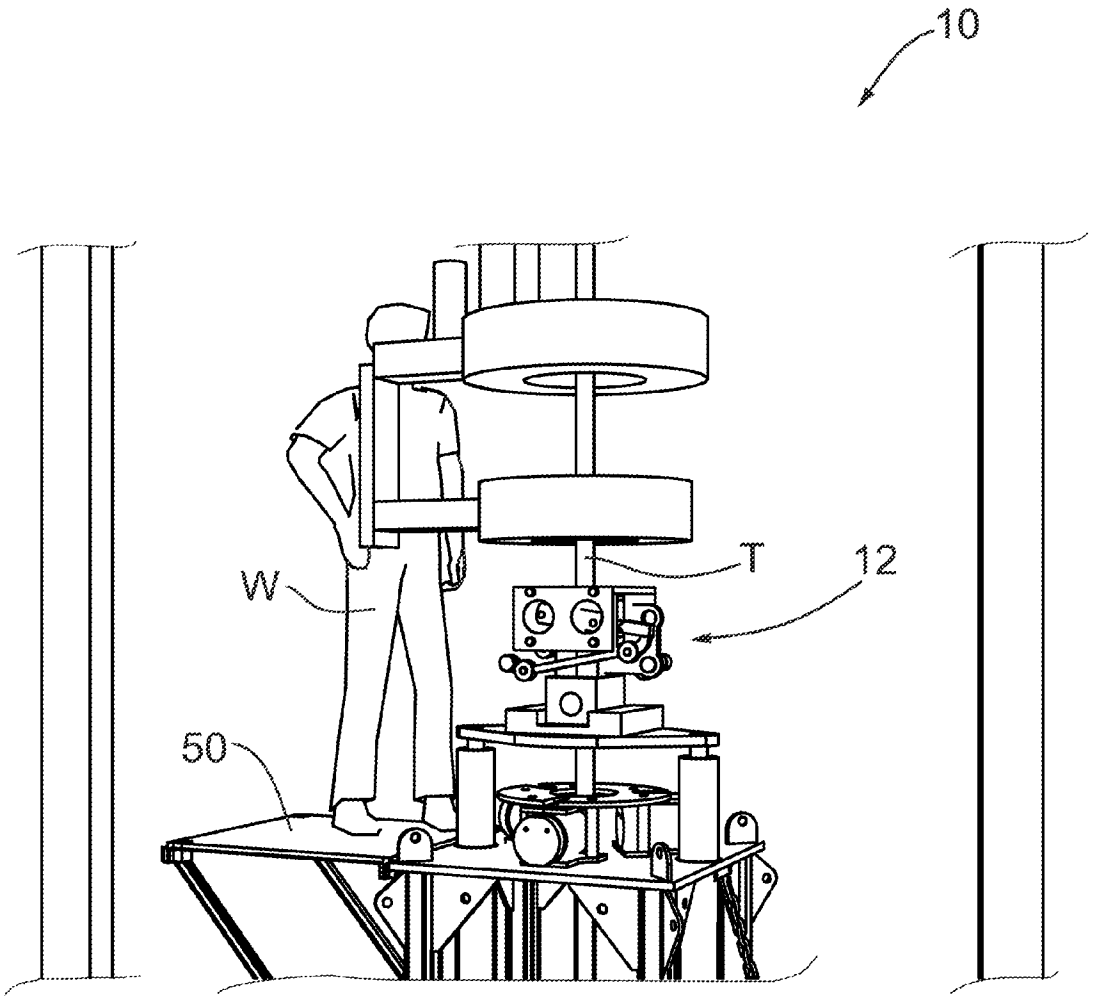

FIG. 13 illustrates an alternate embodiment of the invention 10, which is similar to the embodiment of FIGS. 1-12, but wherein the compact snubbing unit 12 does not comprise a stationary plate, wherein the ram passages 22*a*, 22*b* are adapted to act as, and have similar dimension to, the ram recesses 15*a*, 15*b* of the embodiment in FIGS. 1-12, and wherein the jacking rams 16*a*, 16*b* are securably mounted directly to the support plate 22 of the support structure 20 (in a similar or identical manner as they are mounted to the stationary plate 15*s* of the embodiment of FIGS. 1-12) through use of ram retainers 17*a*, 17*b*. This embodiment would operate in a similar manner as that of the embodiment of FIGS. 1-12.

Third Embodiment

FIGS. 14-18 illustrate the configuration of another embodiment of the present invention 10 which is similar to the embodiment of FIGS. 1-12, but which further comprising a worker platform 50 to support a worker W. Advantageously, the worker platform 50 places a worker W in a safe and efficient position to conduct well operations and to handle the tubular components T. More advantageously, the worker W is only placed a few feet above the rig floor RF and can simply step onto the worker platform 50 without need of ladders or other means to climb up to a greatly elevated position as is the case with conventional snubbing units (see, for example, FIG. 15 where worker W is shown on the worker platform 50 only about 2 to 3 feet above the rig floor RF).

Advantages:

Advantages of the invention 10, of the prior art snubbing units and/or push/pull units, include:

It is of simple design.

It accepts existing compact snubbing units and is able to retrofit such existing units to convert them into a push/pull system.

It provides a safer working environment for a rig worker, especially the embodiment having a worker platform.

It is cost efficient in that existing compact snubbing units can be used for both snubbing and push/pull applications.

Those of ordinary skill in the art will appreciate that various modifications to the invention as described herein will be possible without falling outside the scope of the invention.

I claim:

1. A support structure for use on a rig floor and for supporting a unit used to manipulate tubular components in and out through a wellhead, comprising:

a support plate adapted to securely mount the support structure to said unit used to manipulate tubular components in and out through a wellhead and adapted to distribute downward forces to the rig floor;

a passage in the support plate of sufficient diameter to allow tubular components to pass therethrough;

a plurality of rig engaging members connected to the support plate;

at least one tensile member mount;

wherein the unit used to manipulate tubular components in and out through a wellhead does so co-axially through said passage in the support plate; and wherein the support structure is adapted to be placed on the rig floor;

wherein said unit used to manipulate tubular components through a wellhead further comprises a plurality of ram recesses, each suitable to receive a jacking ram, the support structure further comprising:

a plurality of ram passages in the support plate coaxially aligned with the plurality of ram recesses, each ram passage being of sufficient diameter to allow a jacking ram to pass therethrough; and wherein, during operations, any downward forces are generally distributed into the rig floor through the support structure and the plurality of rig engaging members.

2. The support structure of claim 1 where the unit used to manipulate tubular components through a wellhead is a compact snubbing unit.

3. The support structure of claim 1 where the unit used to manipulate tubular components through a wellhead is a push/pull unit.

4. The support structure of claim 1, further comprising a worker platform adjacent the support plate to support a worker above the rig floor.

5. A push/pull system for use on a rig to manipulate tubular components co-axially in and out through a wellhead, the system comprising:

a unit used to manipulate tubular components co-axially in and out through a wellhead;

the support structure of claim 1 to support said unit used to manipulate tubular components co-axially in and out through a wellhead at a position above the rig floor and having a plurality of tensile member mounts; and a plurality of tensile members connected between the support structure's plurality of tensile member mounts and a plurality of mounting points on the rig or the rig floor, plurality of tensile members adapted to overcome any well pressure-generated forces on the tubular components which would otherwise urge the tubular components out of the wellhead.

6. The system of claim 5, wherein the plurality of rig engaging members are positioned between the support plate and the rig floor.

7. The system of claim 5 where the unit used to manipulate tubular components through a wellhead is a compact snubbing unit.

8. The system of claim 5 where the unit used to manipulate tubular components through a wellhead is a push/pull unit.

9. The system of claim 5, further comprising a worker platform to support a worker above the rig floor.

10. A push/pull unit for use on a rig floor and for manipulating tubular components co-axially in and out through a wellhead, said push/pull unit comprising:

a support plate adapted to distribute downward forces to the rig floor, said support plate further comprising a plurality of ram recesses;

a passage in the support plate of sufficient diameter to allow tubular components to pass therethrough;

a plurality of rig engaging members connected to, and projecting substantially downward from, the support plate;

a plurality of tensile member mounts;

a traveling slip assembly;

a stationary slip assembly having a stationary plate, said stationary plate mounted to the support plate;

at least one jacking ram securably mounted between the support plate and the traveling slip assembly, said at least one jacking ram further comprising an annular groove of such dimensions to allow secure placement of said at least one jacking ram within at least one of said plurality of ram recesses;

wherein said traveling slip assembly, said stationary slip assembly and said at least one jacking ram are actuatable to manipulate tubular components co-axially in and out through a wellhead; and wherein, during operations, any downward forces are generally distributed into the rig floor through the support structure and the plurality of rig engaging members.

11. The support structure of claim 1 wherein the jacking rams each further comprising an annular groove of such dimensions to allow secure placement of said jacking rams within said plurality of ram recesses.

12. The support structure of claim 11, further comprising a plurality of ram retainers to maintain secure placement of the jacking rams within said plurality of ram recesses.

13. A support structure for use on a rig floor and for supporting a unit used to manipulate tubular components through a wellhead, said unit having a plurality of jacking rams, the support structure comprising:

a support plate adapted to securely mount the support structure within said unit used to manipulate tubular components through a wellhead and further adapted to distribute downward forces to the rig floor;

a passage in the support plate of sufficient diameter to allow tubular components to pass therethrough;

a plurality of rig engaging members connected to the support plate;

a plurality of tensile member mounts;

a plurality of ram passages in the support plate adapted to securably mount the plurality of jacking rams;

wherein the support structure is adapted to be placed on the rig floor;

wherein, during operations, any downward forces are generally distributed into the rig floor through the support structure and the plurality of rig engaging members; and wherein the jacking rams each further comprising an annular groove of such dimensions to allow secure placement of said jacking rams on the support plate.

14. The support structure of claim 13, further comprising a plurality of ram retainers to maintain secure placement of the jacking rams on the support plate.

* * * * *